US010987527B1

(12) United States Patent
Gray

(10) Patent No.: US 10,987,527 B1
(45) Date of Patent: Apr. 27, 2021

(54) NASAL AIR FILTRATION DEVICE

(71) Applicant: Erick Gray, Houston, TX (US)

(72) Inventor: Erick Gray, Houston, TX (US)

( * ) Notice: Subject to any disclaimer, the term of this patent is extended or adjusted under 35 U.S.C. 154(b) by 372 days.

(21) Appl. No.: 16/239,636

(22) Filed: Jan. 4, 2019

(51) Int. Cl.
*A62B 23/06* (2006.01)
*A62B 7/10* (2006.01)
*A62B 18/02* (2006.01)

(52) U.S. Cl.
CPC ..... *A62B 23/06* (2013.01); *A62B 7/10* (2013.01); *A62B 18/02* (2013.01)

(58) Field of Classification Search
CPC . A62B 7/10; A62B 18/088; A62B 23/00–025; A62B 23/06; A61M 16/0666; A61M 29/00; A61M 15/08; A61M 15/085; A61M 2025/0226; A61M 2210/0618; A61F 5/08; A61F 5/56; A61F 2/18; A61F 2/186
See application file for complete search history.

(56) References Cited

U.S. PATENT DOCUMENTS 7,156,098 B2 1/2007 Dolezal et al.
8,070,744 B1 * 12/2011 Clements ..... A61M 1/0052 604/540
9,205,218 B1 * 12/2015 Bachan ..... A62B 7/10
9,433,808 B2 9/2016 Curtis
9,730,830 B2 8/2017 Foley et al.
2019/0328575 A1 * 10/2019 Draper ..... A61F 7/007
2020/0215281 A1 * 7/2020 Jerasi ..... A61M 16/0066

* cited by examiner

*Primary Examiner* — Rachel T Sippel
(74) *Attorney, Agent, or Firm* — Sanchelima & Associates, P.A.; Christian Sanchelima; Alexander J. Rodriguez

(57) ABSTRACT

A nasal air filtration device for filtering air inhaled by a user is disclosed. The nasal air filtration device includes a pair of nostril tubes including a filter at one end and an ionic plate at other end. Each of the nostril tubes includes a cup having a plurality of openings. The nasal air filtration device includes a base tube coupled to the nostril tubes. The base tube includes an exhaust channel. The base tube includes a first housing having a battery and a second housing having a fan. In order to filter the air inhaled by a user, the nostril tubes are placed inside nostrils of the user. When the user inhales, the fan is operated to draw the air into the base tube, and the air is made to pass through the filter and the ionic plate provided at the nostril tubes into the nostrils via the openings. When the user exhales, the air is released into the atmosphere through the exhaust channel via the nostril tubes.

7 Claims, 4 Drawing Sheets

NASAL AIR FILTRATION DEVICE

BACKGROUND OF THE INVENTION

1. Field of the Invention

The present disclosure generally relates to air filtration devices. More particularly, the present disclosure relates to a nasal air filtration device insertable into nasal cavities for filtering ambient air as it is inhaled.

2. Description of the Related Art

With increase in industrialization, humans are releasing excessive amount of greenhouse gases into atmosphere. Further, with increase in use of vehicles, burning of fossil fuels, waste, construction, mining and other known mechanisms, people are increasingly polluting or contaminating the air. These environments may harbor virulent, bacteria, pollen, smoke, dust mites and other germs that cause a reaction when ingested by an individual.

Typically, protective masks or surgical masks have been used to couple to people's nose and mouth, which help to filter the air breathed by the people. The protective masks may be used to reduce inhalation of dust and other airborne particulates. As known, the protective masks are made of a variety of air-permeable materials, including one or more layers of woven or non-woven fabrics and materials, and are generally disposed of after a single use. The protective masks may be molded into a domed shape, which fits on the wearer's face over the nose and mouth, and is secured around the wearer's head by an elastic band.

Although the protective masks are useful to some extent to reduce inhalation of dust and other airborne particulates, they are ineffective due to perimeter leakage between the mask and face. Further, the wearer may refuse to wear them, due to discomfort or dissatisfaction with the appearance of the mask.

Further, with increase in need for effective filtration of breathing air and to reduce inhaled quantities of particulates and contaminants such as dust and pollen, several nasal filtration devices have proposed in the past that provide the protection offered by filtration masks but without the bulkiness and negative presentation that accompanies a complete nose and mouth covering.

One such example of a nasal filtration device is disclosed in a granted U.S. Pat. No. 7,156,098. In U.S. Pat. No. 7,156,098B2, a nasal air filtration device includes a pair of concave-convex filters, and a support structure incorporating a pair of generally annular bases for supporting the filters, and a bridge that couples the bases, to maintain them in a desired spaced-apart relation and to determine a desired angular relationship between the bases and between the associated filters is disclosed.

Another example of a nasal filtration device is disclosed in a granted U.S. Pat. No. 9,433,808. In U.S. Pat. No. 9,433,808B2, a nasal filtration system that can be inserted into the nasal cavities is disclosed. The filters comprise cavities through which air is inhaled or exhaled. The filter performs as a mechanical filter to catch and prevent the inhalation of undesirable particulate. Further, the filter comprises a disinfectant agent, such as colloidal silver, which kills germs, bacteria, and viruses to prevent the spreading of disease.

Yet another example of a nasal filtration device is disclosed in a granted U.S. Pat. No. 9,730,830. In U.S. Pat. No. 9,730,830B2, a nasal insert comprising a housing defining an interior space and a conoid shaped endmost insert portion adapted to be inserted into a nasal cavity is disclosed.

Although the devices discussed above are helpful in filtering the air inhaled by the user, they have few problems. For example, most of the nasal filtration devices discussed above have a single layer of filter, which is capable to collect solid particulates. As known, the filters that are available today are not capable of colleting fine particulates. As a result, the fine particulates that are harmful may enter nasal cavity and cause diseases.

Other documents describing the closest subject matter provide for a number of more or less complicated features that fail to solve the problem in an efficient and economical way. None of these patents suggest the novel features of the present invention. Specifically, none of the disclosures in the art disclose a nasal air filtration device comprising a pair of nostril tubes, each having a filter at one end and an ionic plate at other end, which helps to filter fine particulates and allow the user to inhale clean air.

Therefore, there is a need in the art for a nasal air filtration device comprising nostril tubes having a filter at one end and an ionic plate at other end, which helps to filter fine particulates and allow the user to inhale clean air.

SUMMARY OF THE INVENTION

It is one of the main objects of the present invention to provide a nasal air filtration device for filtering air inhaled by a user that avoids the drawbacks of the prior art.

It is one object of the present invention to provide a nasal air filtration device comprising nostril tubes having a filter at one end and an ionic plate at other end.

It is one object of the present invention to provide a nasal air filtration device comprising a base tube having at least one housing to have a fan to draw air into the filters.

It is one object of the present invention to provide a nasal air filtration device for filtering air inhaled by a user. The nasal air filtration device comprises a pair of nostril tubes comprising a filter at one end and an ionic plate at other end. Each of the nostril tubes comprises a cup having a plurality of openings. The nasal air filtration device comprises a base tube coupled to the nostril tubes. The base tube comprises an exhaust channel. The base tube comprises a first housing having a battery and a second housing having a fan. In order to filter the air inhaled by a user, the nostril tubes are placed inside nostrils of the user. When the user inhales, the fan is operated to draw the air into the base tube, and the air is made to pass through the filter and the ionic plate provided at the nostril tubes into the nostrils via the openings. When the user exhales, the air is released into the atmosphere through the exhaust channel via the nostril tubes.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a nasal air filtration device for filtering air inhaled by a user. The nasal air filtration device comprises a pair of nostril tubes comprising a filter at one end and an ionic plate at other end. Each of the nostril tubes comprises a cup having a plurality of openings. The nasal air filtration device comprises a base tube coupled to the nostril tubes. The base tube comprises an exhaust channel. The base tube comprises a first housing having a battery and a second housing having a fan. In order to filter the air inhaled by a user, the nostril tubes are placed inside nostrils of the user. When the user inhales, the fan is operated to draw the air into the base tube, and the air is made to pass through the filter and the ionic plate provided at the nostril tubes into the nostrils via the openings. When the user exhales, the air is released into the atmosphere through the exhaust channel via the nostril tubes.

Various features and embodiments of a nasal air filtration device are explained in conjunction with the description of FIGS. 1-4.

Figure 1:
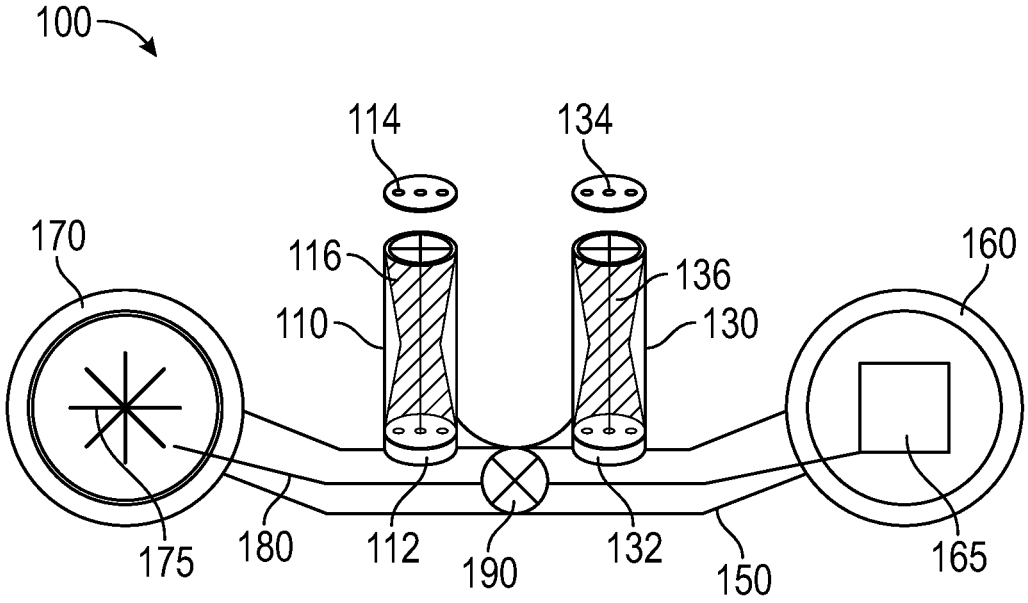
FIG. 1 illustrates a schematic diagram of a nasal air filtration device 100, in accordance with one embodiment of the present disclosure.

Referring to FIG. 1, a schematic diagram of a nasal air filtration device 100 for filtering air is shown, in accordance with one embodiment of the present disclosure. The nasal air filtration device 100 comprises a first nostril tube 110 and a second nostril tube 130. In one example, each of the first nostril tube 110 and the second nostril tube 130 are made up of a plastic, or metal or any other suitable material. The first nostril tube 110 comprises a first filter 112 at one end and a first ionic plate 114 at other end. Further, the first nostril tube 110 comprises a first spindle 116 coupled to the first filter 112 and the first ionic plate 114.

Similarly, the second nostril tube 130 comprises a second filter 132 at one end and a second ionic plate 134 at other end. Further, the second nostril tube 130 comprises a second spindle 136 coupled to the second filter 132 and the second ionic plate 134.

It should be understood that each of the first filter 112 and the second filter 132 may be provided in variety of shapes and sizes and generally includes a centrally disposed synthetic meshed filter region surrounded by an adhesive region. The adhesive region, preferably formed of porous fabric with a hypoallergenic adhesive coating on one side and can be used to couple the first filter 112 to the first nostril tube 110, and the second filter 132 to the second nostril tube 130. In one example, each of the first filter 112 and the second filter 132 may be coated or impregnated with a pharmaceutical compound, which either inhibits allergic reactions or aids in the removal of organics in the air during inspiration. The first filter 112 and the second filter 132 may be made up of fibrous or porous material that helps in removing solid particulates such as dust, pollen, mold, and bacteria from the air.

Further, the first ionic plate 114 and the second ionic plate 134 may be used to collect minute particles that are not collected by the first filter 112 and the second filter 132, respectively.

The first nostril tube 110 and the second nostril tube 130 are coupled using a base tube 150. As can be seen, the first nostril tube 110 and the second nostril tube 130 are provided in relatively parallel manner. Further, the base tube 150 is provided in perpendicular to the first nostril tube 110 and the second nostril tube 130.

In accordance with one embodiment of the present disclosure, the base tube 150 comprises a first housing 160 at one end and a second housing 170 at another end. The first housing 160 comprises a battery 165. The second housing 170 comprises a fan 175. In one example, the second housing 170 comprises a mesh 178 surrounding the fan 175. Further, the battery 165 is coupled to the fan 175 via a cable 180 drawn through the base tube 150.

Further, the base tube 150 comprises an exhaust channel 190 at the bottom. The exhaust channel 190 may be used to release the air exhaled into atmosphere.

Figure 2:
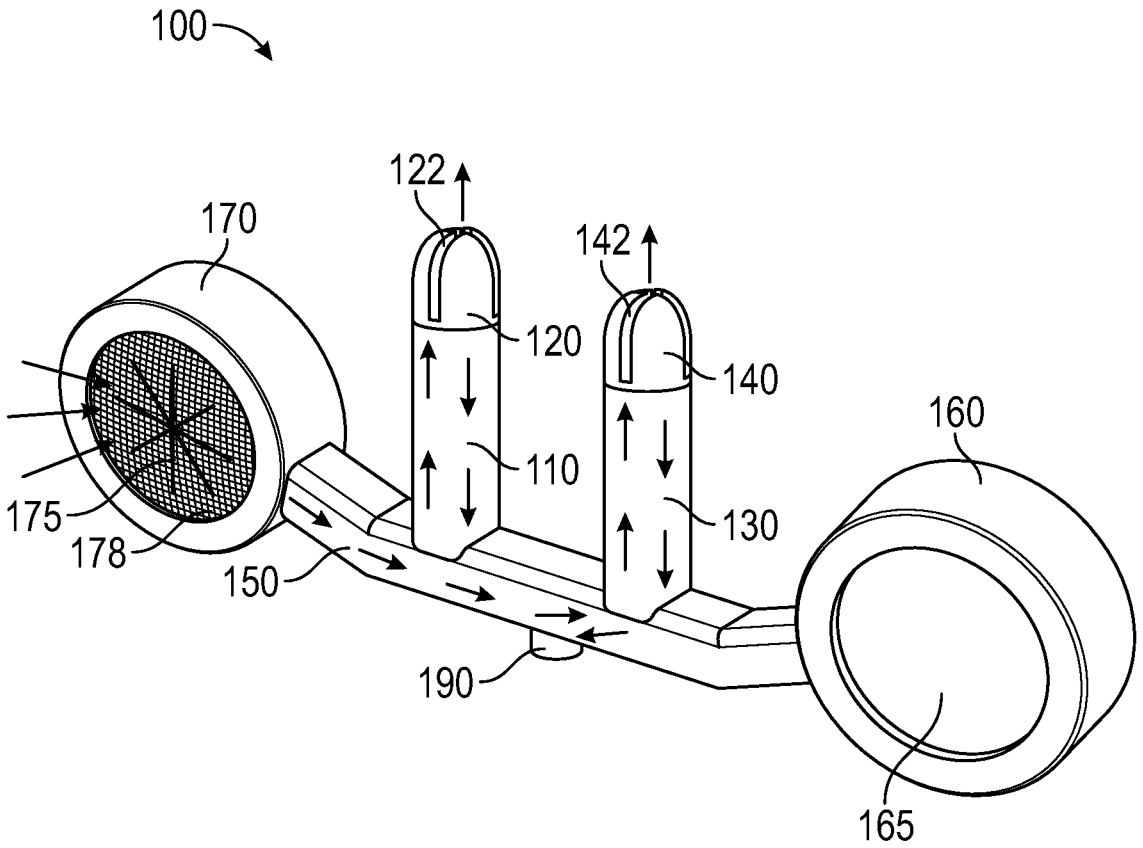
FIG. 2 illustrates a perspective view of the nasal air filtration device 100, in accordance with one embodiment of the present disclosure.

Now referring to FIG. 2, a perspective view of the nasal air filtration device 100, is shown, in accordance with one embodiment of the present disclosure. As can be seen, the first nostril tube 110 comprises a first cap 120 having a plurality of first openings 122. Similarly, the second nostril tube 130 comprises a second cap 140 having a plurality of second openings 142. The first cap 120 and the second cap 140 may be made up of plastic, metal or any other suitable material such that when the nasal air filtration device 100 is inserted in nostrils of a user, the components coming in contact with the nostrils does not harm the user.

Further, referring to FIG. 2, operation of the nasal air filtration device 100 is explained. As specified above, the battery 165 is coupled to the fan 175. When the fan 175 is operated, the fan 175 draws the air from the atmosphere into the base tube 150. Whenever the user inhales, the air drawn by the fan 175 enters the first nostril tube 110 and the second nostril tube 130. As specified above, the first nostril tube 110 and the second nostril tube 130 comprise the first filter 112 and the second filter 132, respectively. As the air passes through the first filter 112 and the second filter 132, solid particulates such as dust, pollen, and bacteria from the air are removed.

Further, fine particulates present in the air that are not collected by the filters 112, 132 are collected by the first ionic plate 114 and the second ionic plate 134 provided in the first nostril tube 110 and the second nostril tube 130, respectively. Subsequently, the air is made to pass through the first openings 122 and the second openings 142 into the nostrils.

Further, when the user exhales, the air is made to pass through the first nostril tube 110 and the second nostril tube 130 via the first openings 122 and the second openings 142, and the first filter 112 and the second filter 132. Subsequently, the air is released into the atmosphere through the exhaust channel 190.

Figure 3:
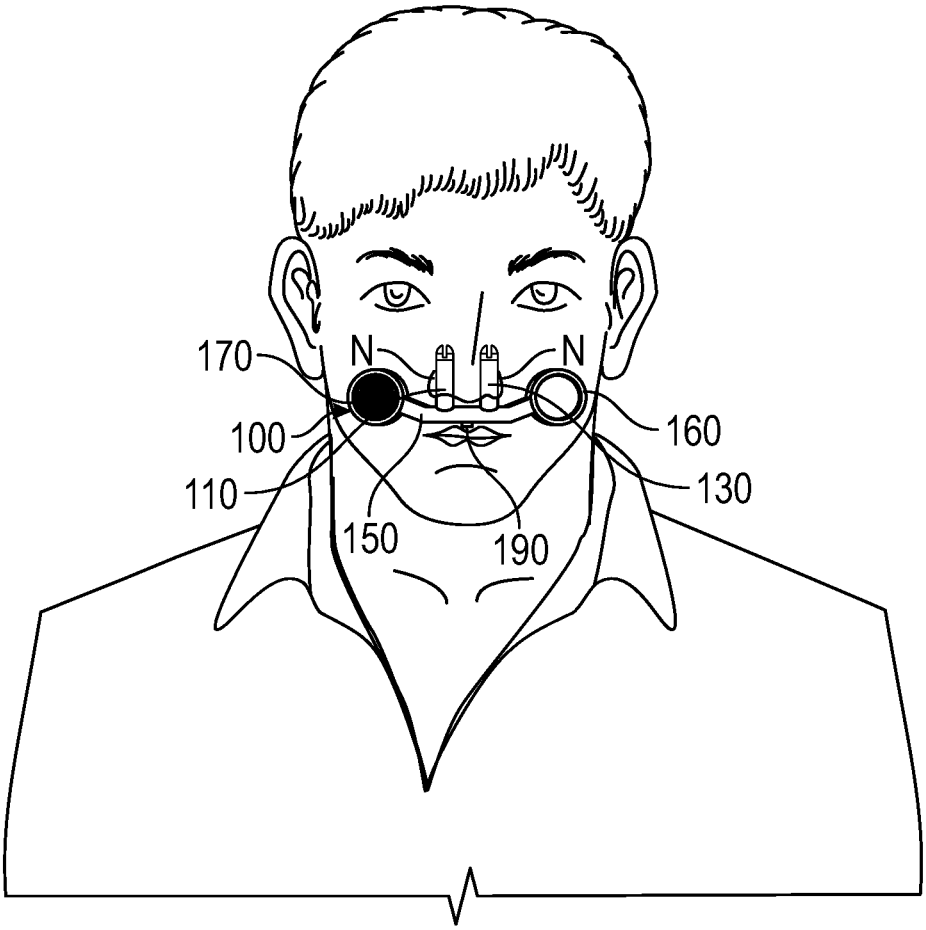
FIG. 3 illustrates the nasal air filtration device 100 inserted into adjacent naval cavities of a user, in accordance with one exemplary embodiment of the present disclosure.

Referring to FIG. 3, a schematic diagram of the nasal air filtration device 100 inserted into adjacent naval cavities N of a user is shown, in accordance with one exemplary embodiment of the present disclosure. As can be seen, the first nostril tube 110 and the second nostril tube 130 are inserted into the both naval cavities N of the user. Further, the base tube 150 acts as a tether for holding the first nostril tube 110 and the second nostril tube 130 to the nose N.

Although the present embodiment is presented to have the battery 165 in the first housing 160 and the fan 175 in the second housing 170, it should be possible to provide the battery 165 and the fan 175 in each of first housing 160 and the second housing 170. In other words, the first housing 160 is provided with the battery 165 and the fan 175, and the second housing 170 is also provided with the battery 165 and the fan 175. This is because to increase the air drawn into the nostril tubes 110, 130 such that the user may be able to inhale sufficient amount of air.

Figure 4:
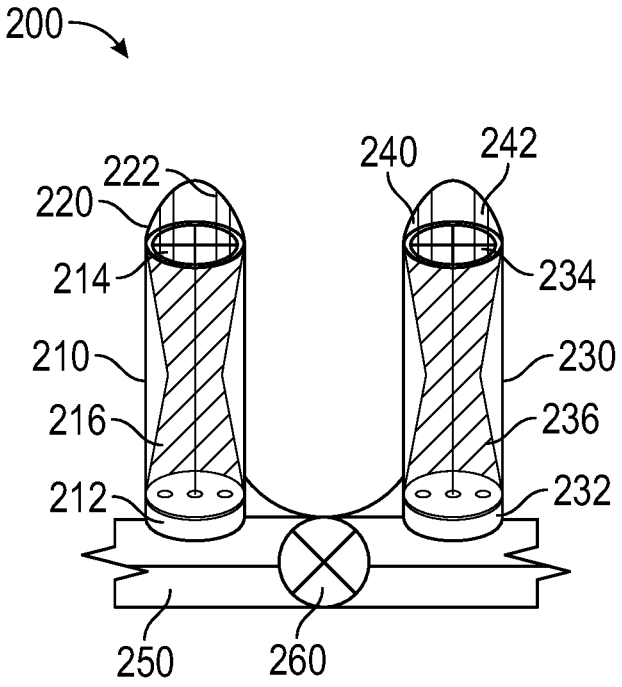
FIG. 4 illustrates a nasal air filtration device 200, in accordance with another embodiment of the present disclosure.

Now referring to FIG. 4, a nasal air filtration device 200 for filtering air inhaled by a user is shown, in accordance with another embodiment of the present disclosure. The nasal air filtration device 200 comprises a first nostril tube 210 comprises a first filter 212 at one end and a first ionic plate 214 at other end. Further, the first nostril tube 210 comprises a first spindle 216 coupled to the first filter 212 and the first ionic plate 214. Further, the first nostril tube 210 comprises a first cap 220 having a plurality of first openings 222.

Similarly, the nasal air filtration device 200 comprises a second nostril tube 230 comprises a second filter 232 at one end and a second ionic plate 234 at other end. Further, the second nostril tube 230 comprises a second spindle 236 coupled to the second filter 232 and the second ionic plate 234. Further, the second nostril tube 230 comprises a second cap 240 having a plurality of second openings 242.

The first nostril tube 210 and the second nostril tube 230 are coupled to a base tube 250 having an exhaust channel 260.

In the current embodiment, when the user inhales, the air enters the first nostril tube 210 and the second nostril tube 230 through the filters 212, 232 and then through into the first openings 222 and the second openings 242. Further, when the user exhales, the air is made to pass through the first nostril tube 210 and the second nostril tube 230 via the first openings 222 and the second openings 242, and the first filter 212 and the second filter 232. Subsequently, the air is released into the atmosphere through the exhaust channel 260. It should be understood that the current embodiment is presented to illustrate that the nasal air filtration device 200 can be used to without the need of the fan and the battery as explained above.

Based on the above, it is evident that the nasal air filtration device disclosed herein can be used to filter the air that the user inhales. Due to the presence of filter, the solid particulates are filtered out first. Subsequently, the ionic plates collect any residual or fine particulates. As such, the air is cleaned before the user breathes the air into the nasal cavity. As a result, the user will be able to breathe clean air and have a healthy life. Further, the fan helps to draw the air into the nostrils tubes. As a result, the user may not have to put pressure to inhale the air when the user wears the nasal air filtration device.

It should be understood that the nasal air filtration device might be provided in different shapes and sizes depending on the user such as children or adult. Further, nasal air filtration device may be made using plastic, aluminum or silver or any other suitable material.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A nasal air filtration device, comprising:

a pair of nostril tubes, each of the nostril tubes comprising a filter at one end and an ionic plate at the other end, a cap provided at each of the nostril tubes, wherein the cap comprises a plurality of openings, wherein the cap is coupled to the nostril tubes at the ionic plate;

a base tube coupled to the nostril tubes; and at least one housing coupled to the base tube, wherein the housing comprises a fan, wherein the nostril tubes are adapted to be placed inside nostrils of a user, such that when the user inhales, the fan draws air into the base tube, and the air is made to pass through the filter and the ionic plate provided at the nostril tubes into the nostrils via the openings.

2. The nasal air filtration device of claim 1, further comprises a battery provided in the at least one housing.

3. The nasal air filtration device of claim 2, wherein the battery is used to power the fan.

4. The nasal air filtration device of claim 3, wherein the battery is coupled to the fan via a cable.

5. The nasal air filtration device of claim 1, wherein the base tube comprises an exhaust channel to release the air exhaled by the user.

6. The nasal air filtration device of claim 1, wherein each of the nostril tubes comprises a spindle between the filter and the ionic plate.

7. A nasal air filtration device, comprising:

a pair of nostril tubes, each of the nostril tubes comprising a filter at one end and an ionic plate at the other end, a cap provided at each of the nostril tubes, wherein the cap comprises a plurality of openings, wherein the cap is coupled to the nostril tubes at the ionic plate;

a base tube coupled to the nostril tubes, wherein the base tube comprises an exhaust channel; and a first housing and a second housing coupled to the base tube at far ends, wherein the first housing comprises a battery, and wherein the second housing comprises a fan;

wherein the nostril tubes are adapted to be placed inside nostrils of a user, such that when the user inhales, the fan is operated to draw air into the base tube, and the air is made to pass through the filter and the ionic plate provided at the nostril tubes into the nostrils via the openings, wherein when the user exhales, the air is released into the atmosphere through the exhaust via the nostril tubes.

* * * * *